US005408380A

United States Patent [19]

Johnson, Jr.

[11] Patent Number: 5,408,380

[45] Date of Patent: Apr. 18, 1995

[54] METHOD AND APPARATUS FOR LOAD VOLTAGE COMPENSATION

[75] Inventor: Harold L. Johnson, Jr., Pauline, S.C.

[73] Assignee: Milliken Research Corporation, Spartanburg, S.C.

[21] Appl. No.: 848,656

[22] Filed: Mar. 9, 1992

[51] Int. Cl.[6] ..... H01H 47/00

[52] U.S. Cl. ..... 361/191; 307/38

[58] Field of Search ..... 307/11, 12, 31, 36, 307/38, 42; 361/139, 160, 170, 191, 192, 193, 206

[56] References Cited

U.S. PATENT DOCUMENTS

| | | | |
|---|---|---|---|
| 3,649,905 | 3/1972 | Krupka . | |
| 3,699,989 | 10/1972 | O'Connor et al. . | |
| 3,963,972 | 6/1976 | Todd | 307/150 |
| 4,084,615 | 4/1978 | Klein et al. . | |
| 4,679,766 | 7/1987 | Cuming . | |
| 4,686,426 | 8/1987 | Fujioka et al. . | |
| 4,739,242 | 4/1988 | McCarty et al. | 320/2 |
| 4,848,943 | 7/1989 | Sutcliffe | 361/152 |
| 4,940,343 | 7/1990 | Kikuchi et al. | 361/153 |
| 4,984,169 | 1/1991 | Johnson, Jr. . | |
| 5,008,516 | 4/1991 | Holling | 361/160 |
| 5,013,139 | 5/1991 | Stopa et al. | 307/150 |
| 5,051,867 | 9/1991 | Burgher et al. | 307/150 |
| 5,068,683 | 11/1991 | Miyazaki | 354/484 |
| 5,124,532 | 6/1992 | Hafey et al. | 320/2 |
| 5,151,727 | 9/1992 | Sasaki | 354/76 |
| 5,189,520 | 2/1993 | Okayasu et al. | 358/229 |
| 5,281,990 | 1/1994 | Huang | 354/484 |

*Primary Examiner*—Jeffrey A. Gaffin

*Attorney, Agent, or Firm*—Kevin M. Kercher; Terry T. Moyer

[57] ABSTRACT

An apparatus and method for load voltage compensation. This involves increasing the length of time voltage is applied to electrical components, e.g., solenoid valves, in direct proportion to the number of electrical components electrically activated to compensate for the voltage loss in the control wires leading to the electrical components. The area of compensated pulse is then equal to the area of uncompensated pulse in order to compensate for the voltage drop. The load is anticipated prior to voltage application by summing the number of electrical components and associated loads selected and applying voltage for a period of time directly proportional thereto.

13 Claims, 3 Drawing Sheets

METHOD AND APPARATUS FOR LOAD VOLTAGE COMPENSATION

BACKGROUND OF THE INVENTION

This invention relates to a method and apparatus for resistive load voltage compensation. When a high voltage pulse activates a number of electrical components, e.g., solenoid valves, there is a voltage loss in the control wires leading to the electric components. This loss is proportional to the load so that when only one electrical component is activated, the load is light, and when a significant number of the electrical components is activated, the load is heavy.

The present invention solves this problem in a manner not disclosed in the known prior art.

SUMMARY OF THE INVENTION

An apparatus and method for resistive and/or inductive load voltage compensation. This involves increasing the length of time voltage is applied to an electrical component, in direct proportion to the number of components electrically activated.

It is an advantage of this invention to apply additional energy to electrical components without increasing the amount of voltage.

Still another advantage of this invention is a longer voltage application time that is directly proportional to the number of electrical components activated.

Another advantage of this invention is the area of a compensated voltage pulse is equal to the area of a noncompensated voltage pulse with no load.

A further advantage of this invention is that the number of electrical components to be activated can be anticipated prior to activation.

These and other advantages will be in part apparent and in part pointed out below.

BRIEF DESCRIPTION OF THE DRAWINGS

The above as well as other objects of the invention will become more apparent from the following detailed description of the preferred embodiments of the invention when taken together with the accompanying drawings, in which.

DETAILED DESCRIPTION OF THE PREFERRED EMBODIMENT

Figure 1:
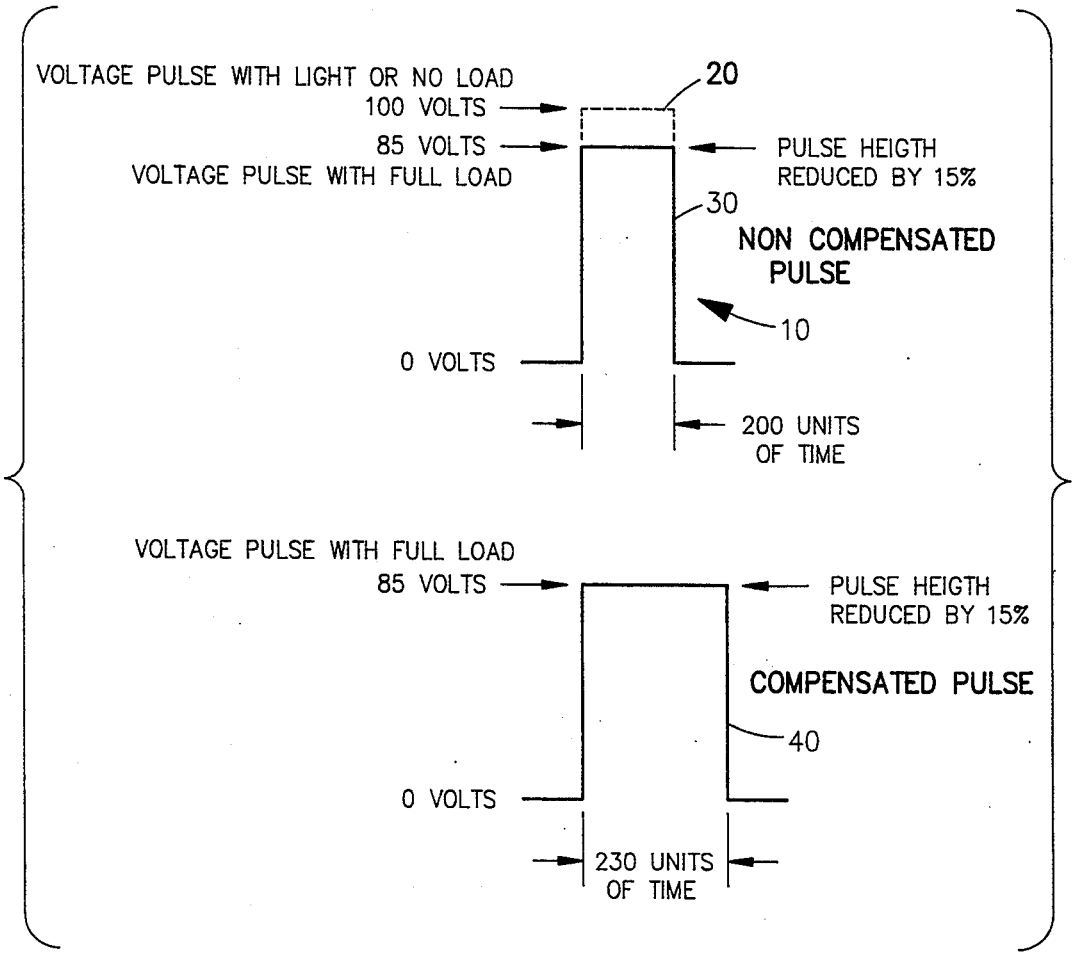
FIG. 1 is a comparative diagram of a compensated voltage pulse and a noncompensated voltage pulse.

Referring now to the accompanying drawings, and initially to FIG. 1, which shows a comparative diagram of a noncompensated voltage pulse and a compensated voltage pulse for the activation of a plurality of electrical components. It can be appreciated that voltage drop or loss in a system is directly related to the number of electrical components utilized in a system and the length of electrical conductors extending from the power source to the plurality of electrical components. The term "load" utilized throughout this Application refers to resistive and/or inductive load. An excellent example of this type of technology is the pattern application of dye on a substrate wherein continuously flowing streams of liquid normally directed in paths to impinge upon the substrate are selectively deflected from contact with the substrate in accordance with pattern information. The substrate is thus dyed in a desired pattern and the deflected dye is collected and recirculated for use. Each continuously flowing liquid stream is selectively deflected by a stream of air that is discharged, in accordance with pattern information, from an air outlet located adjacent each liquid discharge outlet. The air outlet is positioned to direct the air stream into intersecting relation with the liquid stream and to deflect the liquid into a collection chamber or trough for recirculation. Each individual air stream is controlled by a solenoid. Therefore, for intricate patterns, the number of solenoids utilized can be extensive. This method and apparatus for dyeing and printing substrates is shown, for example, in U.S. Pat. No. 4,984,169 issued Jan. 8, 1991, the disclosure of which is hereby incorporated by reference. The solenoid valves that are typically used in the above application normally operate at fifteen (15) volts. By increasing the voltage to 100 volts for a short period of time, just as the solenoid valve is activated, the time required to activate the valve is reduced substantially. This technique works well, however, this vast increase in voltage also results in significant power loss in the electrical conductor extending between the power source and the plurality of solenoid valves. The voltage loss in the electrical conductor is directly proportional to the number of valves activated. Therefore, when just a few solenoid valves are activated, the response time is significantly shorter then when a large number of valves are activated. Please keep in mind that the electrical components presented in this Application are solenoid valves, however, relays, coils, resistors, and any other type of electrical component may be compensated with this technology. In addition, any type of solenoid valve may be utilized with the fifteen volt solenoid utilized as a non-limiting example.

The solution to the problem of voltage drop due to load variance is solved by anticipating the load and supplying additional energy by lengthening the time energy is applied. A non-limiting example is directed to the substrate patterning technology found in U.S. Pat. No. 4,984,169. As shown in FIG. 1, the non compensated control pulse is generally referenced by numeral 10. The voltage pulse with no-load will be at one hundred volts 20 and the voltage load a full load will be at eighty-five volts 30. This is for two-hundred units of time. The voltages and time periods utilized throughout this Application directly relate to the substrate patterning technology found in U.S. Pat. No. 4,984,169 and are for illustrative purposes only and are not to be deemed limiting in any way. By analyzing the solenoid activation data just prior to activation, the number of valves to be activated can be determined. This will be directly proportional to the load. This data will allow the control voltage pulse to be lengthened to compensate for the voltage drop as shown by numeral 40 in FIG. 1. Since this is at 230 units of time, then the area of the compensated voltage pulse 40 is equal to the area of the non-compensated voltage pulse with no load 20.

Data can be transmitted from the control system to the plurality of solenoids by means of parallel data lines or by a single data line. As an illustrative, non-limiting example is the use of four data lines utilized in conjunction with the substrate patterning technology found in U.S. Pat. No. 4,984,169. Data is sent serially from the control system to each bank of solenoid valves which make up a color bar for distributing a particular color of dye horizontally across the substrate. A logic 1 or positive five (5) volts causes selected valves to activate. A logic 0 or zero (0) volts causes selected valves not to activate. In this manner, the application of dye onto the substrate may be patterned by the control system. As each pattern line of data is sent to the color bar the supply voltage for the solenoid valves, which normally operate at fifteen (15) volts, is increased to one hundred (100) volts for a preset period of time. This causes the valves that were selected to activate by means of the data transmitted over the data lines to activate faster than they normally would at fifteen volts. As previously stated, if the pattern commanded only a small number of solenoid valves to activate, then very little of the one-hundred volts would be lost in the electrical connector between the control system and the plurality of solenoid valves due to conductor resistance and inductance. However, if a large number of solenoid valves are commanded to activate by the control system, then more of the one-hundred volts will be lost in the electrical conductor and less voltage will be applied to the solenoid valves. The solution is to apply additional energy to the valves in a proportional manner to the number of valves commanded to activate. For safety reasons, it is not desirable to increase the voltage, however, the length of time the one-hundred volts is applied can be increased.

Figure 2:
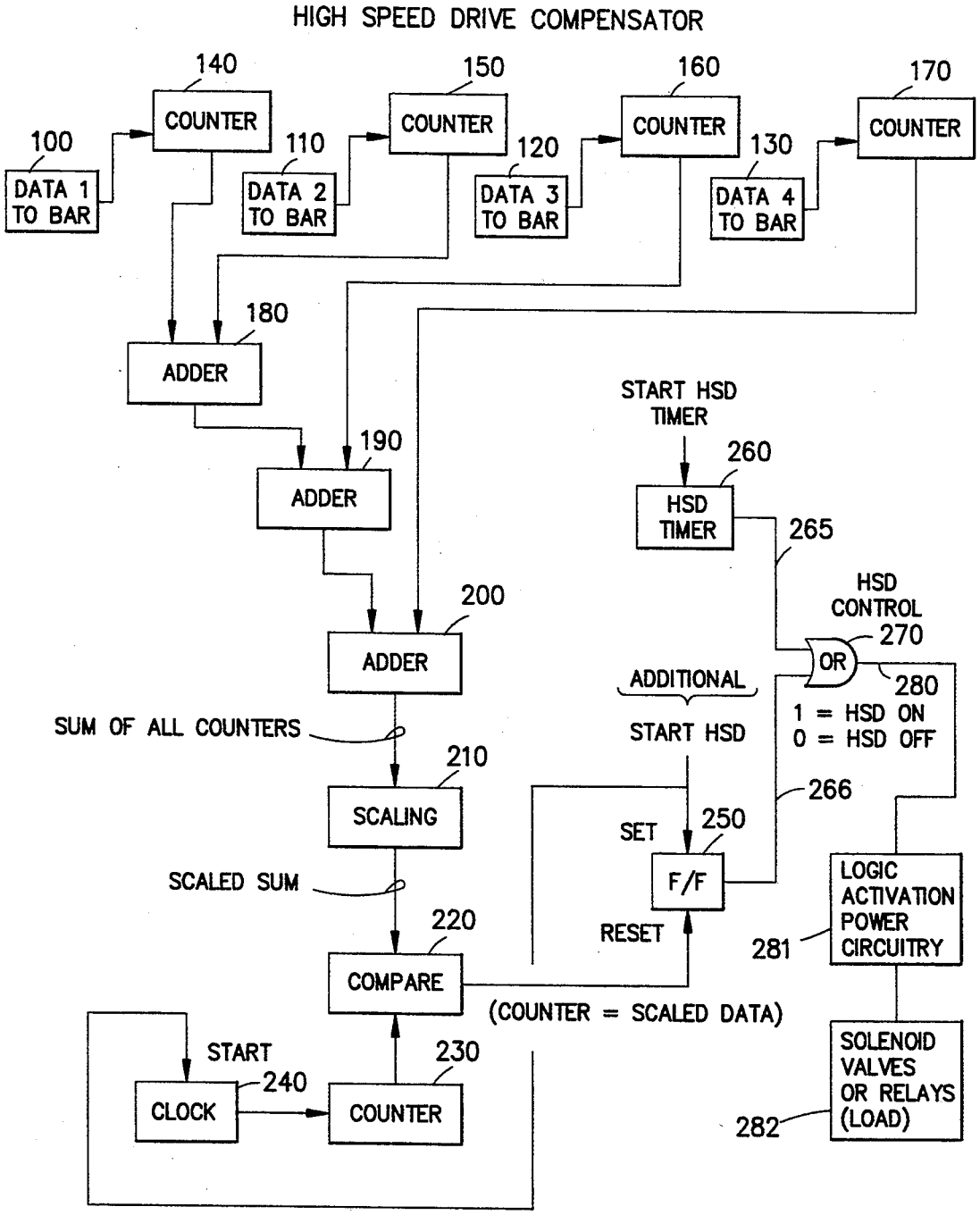
FIG. 2 is a block diagram disclosing, in overview, the novel high speed drive compensator system disclosed herein.

An example of an application of this concept can be found in FIG. 2. There are four data lines 100, 110, 120 and 130, respectively, that are each connected to a counter 140, 150, 160 and 170, respectively. These counters 140, 150, 160 and 170 count the number of logical ones in each data line 100, 110, 120 and 130, respectively. A non-limiting example of this type of counter would be a 74HC 4040. The contents of all four counters 140, 150, 160 and 170 are summed or added together. The contents of counter 140 are added to the contents of counter 150 by adder 180 and then added to the contents of counter 160 by adder 190 and then added to the contents of counter 170 by adder 200. Therefore, the sum of all four counters will be found in adder 200. A non-limiting example of adders of this type would include 74HC283. The summed output of the counters represents the total number of valves that will be commanded to activate in this cycle. This number can be quite large, therefore, it is preferred to have this number scaled down by selecting eight of the high order binary bits. This will provide two hundred and fifty-six combinations or increments of adjustment. The number eight was chosen for the substrate patterning technology found in U.S Pat. No. 4,984,169, however, this number could have been larger or smaller depending on how many increments of adjustments were needed. This scaling function 210 operating on the contents of Adder 200 and should not be limited to the selection of eight of the high order binary bits since there are numerous means and methods of scaling.

Figure 3:
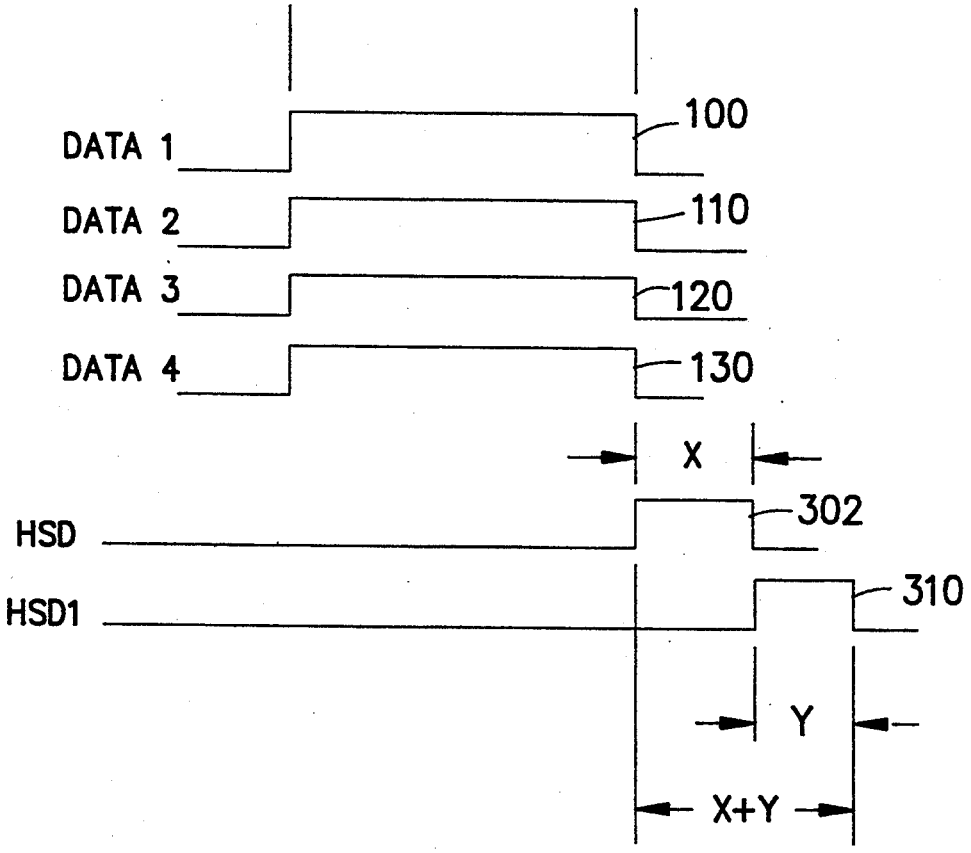
FIG. 3 is a comparative diagram of four data pulses, high speed drive pulse, and compensated high speed drive pulse.

When the data transmission to the color bar (individual set of solenoid valves) has started, the High Speed Drive Timer 260 is activated. As shown in FIG. 3, when the four data signals 100, 110, 120 and 130 end, then the High Speed Drive Timer 260 starts, which places a logical one or positive five volts on OR gate 270 through input line 265. OR gate 270 will trigger the application of one hundred (100) volts by means of logic activation power circuitry 281 to the solenoid valves 282 or other type of electrical component for a period of time equal to the time necessary to activate the valves if no voltage would be lost due to resistance and/or inductance. This is considered the minimum high speed drive time (HSD) as is visually depicted in FIG. 3 by voltage waveform 302 with a time duration of X. The other input line 266 to the OR gate 270 would not affect this function since the OR gate 270 provides a logically disjunctive function, as shown in FIG. 2. When the high speed drive timer 260 times out, it causes flip/flop 250 to set and the clock 240 to start. Since the output line 266 of flip/flop 250 is inputed into OR gate 270, then the logically disjunctive aspect of the OR gate 270 will again trigger the application of one hundred (100) volts by means of the logic activation power circuitry 281 to activate the solenoid valves 282. The output of clock 240 will cause counter 230 to increment. Counter 230 can be a 74HC 4040, but not necessarily. The output of counter 230 is connected to a comparator 220. The second input to comparator 220 is connected to the scaling function 210, which is the scaled sum of the four counters 140, 150, 160 and 170, respectively. Each time the dock 240 increments the clock counter 230, the comparator 220 checks the contents of the counter 230 against the scaled sum resulting from the scaling function 210. When the two values are equal, the comparator 220 resets the flip/flop 250 that places a logical zero (0) or no voltage on line 266 thereby deactivating OR gate 270 since line 265 is already at logical zero or no voltage. This will result in the turning off of the one-hundred (100) volts to the solenoid valves 282. This second application of one-hundred (100) volts to the solenoid valves is shown by voltage waveform 310 shown in FIG. 3 as High Speed Drive 1 (HSD1) with a time duration of Y. Therefore, the total time that one hundred volts are applied to the plurality of solenoids is X+Y. Y is directly proportional to the number of solenoid valves triggered. Since the clock 240 is based on incrementally increasing the value of time, the larger the scaled data value, the longer time that voltage is applied to the solenoid valves. FIG. 3 represents the relative time frame of the inputting of data from the four data lines 100, 110, 120 and 130 into counters 140, 150, 160 and 170 respectively, which is followed by the voltage application 302 for time X and concluded with the voltage application for time Y.

Therefore, it is not intended that the scope of the invention be limited to the specific embodiments illustrated and described. Rather, it is intended that the scope of the invention be defined by the appended claims and their equivalents.

What is claimed is:

1. A system for compensating for voltage load losses comprising of:

(a) a plurality of loads; and (b) a means for selectively applying voltage to at least one of said loads for a first period of time, wherein said means for selectively applying a voltage to at least one of said loads for a first period of time includes a first timing means for controlling the duration of voltage application and a means for continuing said selective application of voltage to said loads for a second period of time, wherein said means for continuing said selective application of voltage to said loads for a second period of time includes a means for computing a total sum of loads selected and a means for maintaining voltage to said selected loads for said second period of time that is directly proportional to said total sum of loads selected.

2. A system for compensating for voltage load losses as defined in claim 1, wherein each of said plurality of loads includes a coil means coupled to an electrical conductor wherein said electrical conductor is coupled to said means for selectively applying voltage.

3. A system for compensating for voltage load losses as defined in claim 2, wherein said coil means is a solenoid valve.

4. A system for compensating for voltage load losses as defined in claim 2, wherein said coil means is a relay.

5. A system for compensating for voltage load losses as defined in claim 1, wherein said means for maintaining voltage to said selected loads for said second period of time that is directly proportional to said total sum of loads selected further includes a second timing means operatively coupled to and triggered by said first timing means to activate immediately after said first period of time coupled to a means for incrementally counting said second timing means and a means for comparison coupled to said means for computing a total sum of loads selected.

6. A system for compensating for voltage load losses as defined in claim 5, further comprising a means for terminating the application of voltage to said selected loads immediately after said second period of time coupled to said means for comparison.

7. A system for compensating for voltage load losses as defined in claim 1, wherein said means for computing a total sum of loads selected further includes a means for scaling said sum of loads selected.

8. A process for compensating for voltage load losses which comprises applying voltage selectively to at least one of a plurality of loads for a first period of time, wherein said step of applying a voltage selectively to at least one of said plurality of loads further comprises maintaining said selective voltage application for said first period of time and continuing said selective application of voltage to said loads for a second period of time, wherein said step of continuing said selective application of voltage to said loads for a second period of time includes summing selected loads selected and maintaining voltage to said selected loads for said second period of time that is directly proportional to a total sum of said selected loads.

9. A process for compensating for voltage load losses as defined in claim 8, wherein each of said plurality of loads includes a coil means coupled to an electrical conductor.

10. A process for compensating for voltage load losses as defined in claim 9, wherein said coil means is a solenoid valve.

11. A process for compensating for voltage load losses as defined in claim 9, wherein said coil means is a relay.

12. A process for compensating for voltage load losses as defined in claim 8, further comprising a step of terminating the application of voltage to said selected loads immediately after said second period of time.

13. A process for compensating for voltage load losses as defined in claim 8, wherein said step of computing a total sum of loads selected further includes a step of scaling said sum of loads selected.

* * * * *